US009501027B2

(12) United States Patent
Wada

(10) Patent No.: US 9,501,027 B2
(45) Date of Patent: Nov. 22, 2016

(54) IMAGE FORMING APPARATUS HAVING A WAVELIKE PORTION CAPABLE OF EXPANDING AND CONTRACTING

(71) Applicant: KYOCERA Document Solutions Inc., Osaka (JP)

(72) Inventor: Hiroshi Wada, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/962,196

(22) Filed: Dec. 8, 2015

(65) Prior Publication Data

US 2016/0161907 A1 Jun. 9, 2016

(30) Foreign Application Priority Data

Dec. 9, 2014 (JP) ..... 2014-248519

(51) Int. Cl.
*G03G 21/16* (2006.01)

(52) U.S. Cl.
CPC ..... *G03G 21/1633* (2013.01)

(58) Field of Classification Search
CPC ..... G03G 2221/1687
See application file for complete search history.

(56) References Cited

U.S. PATENT DOCUMENTS 4,555,173 A * 11/1985 Iseki ..... G03G 15/6502 399/125
4,912,510 A * 3/1990 Ogura ..... G03B 27/32 206/393
2009/0113805 A1* 5/2009 Kuramata ..... E05C 17/36 49/399

FOREIGN PATENT DOCUMENTS

JP 2005-141020 6/2005
JP 2013-195870 9/2013

* cited by examiner

*Primary Examiner* — Clayton E Laballe
*Assistant Examiner* — Victor Verbitsky
(74) *Attorney, Agent, or Firm* — Wenderoth, Lind & Ponack, L.L.P.

(57) ABSTRACT

The one end portion and the other end portion of the support member have tapered portions, respectively, and thickness of each tapered portion is gradually reduced toward a center side from an end side of the support member in a longitudinal direction.

2 Claims, 11 Drawing Sheets

Right and left direction of image forming apparatus

Left side ◄——► Right side

Right and left direction of image forming apparatus

Left side ◄——► Right side

Right and left direction of image forming apparatus

Left side ← → Right side

IMAGE FORMING APPARATUS HAVING A WAVELIKE PORTION CAPABLE OF EXPANDING AND CONTRACTING

CROSS-REFERENCE TO RELATED APPLICATION

This application is based upon and claims the benefit of priority from Japanese Patent Application No. 2014-248519 filed on Dec. 9, 2014, the entire contents of which are incorporated herein by reference.

BACKGROUND

The technology of the present disclosure relates to an image forming apparatus.

Conventionally, there has been known an image forming apparatus in which a jam handling opening is formed at one side of a housing accommodating an image forming unit. The housing is provided therein with a paper conveyance path from a paper feeding unit to a paper discharge unit via the image forming unit, and the aforementioned opening is provided at a side wall part adjacent to the paper conveyance path. The opening is covered by a cover member so as to be openable and closable. When a jam has occurred in the paper conveyance path, a user can open the cover member, thereby performing a removal work of a jammed paper in the paper conveyance path. The cover member is integrally mounted with a transfer roller, a resist roller, and a paper guide member.

The cover member is pivotally supported to a lower edge portion of the aforementioned opening and rotates by employing the pivotally supported part as a fulcrum, thereby allowing the opening to be openable and closable. The aforementioned image forming apparatus is further provided with a flexible support member for restricting an opening angle of the cover member to a maximum opening angle at the time of opening of the cover member. The support member has one end portion fixed to the cover member by a screw and the like, and the other end portion mounted at the housing by a screw and the like.

SUMMARY

An image forming apparatus according to one aspect of the present disclosure includes a housing, a cover member, and a support member. The housing accommodates an image forming unit therein. The housing is formed at one side surface thereof with an opening. The cover member is configured to be pivotally supported to a lower edge portion of the opening and to be rotated to an outer side of the aforementioned housing from a closed state, in which the opening is closed, by employing a shaft as a fulcrum, thereby opening the opening. The support member includes a long belt-shaped member. The support member has one end portion mounted at the aforementioned housing and the other end portion mounted at the cover member. The support member restricts an opening angle of the cover member to a predetermined maximum opening angle.

Furthermore, the one end portion and the other end portion of the aforementioned support member have tapered portions, respectively. Each tapered portion is formed such that its thickness is gradually reduced toward a center side from an end side of the support member in a longitudinal direction.

DETAILED DESCRIPTION

Hereinafter, an example of an embodiment will be described in detail on the basis of the drawings. It is noted that the technology of the present disclosure is not limited to the following embodiments.

Embodiment

Figure 1:
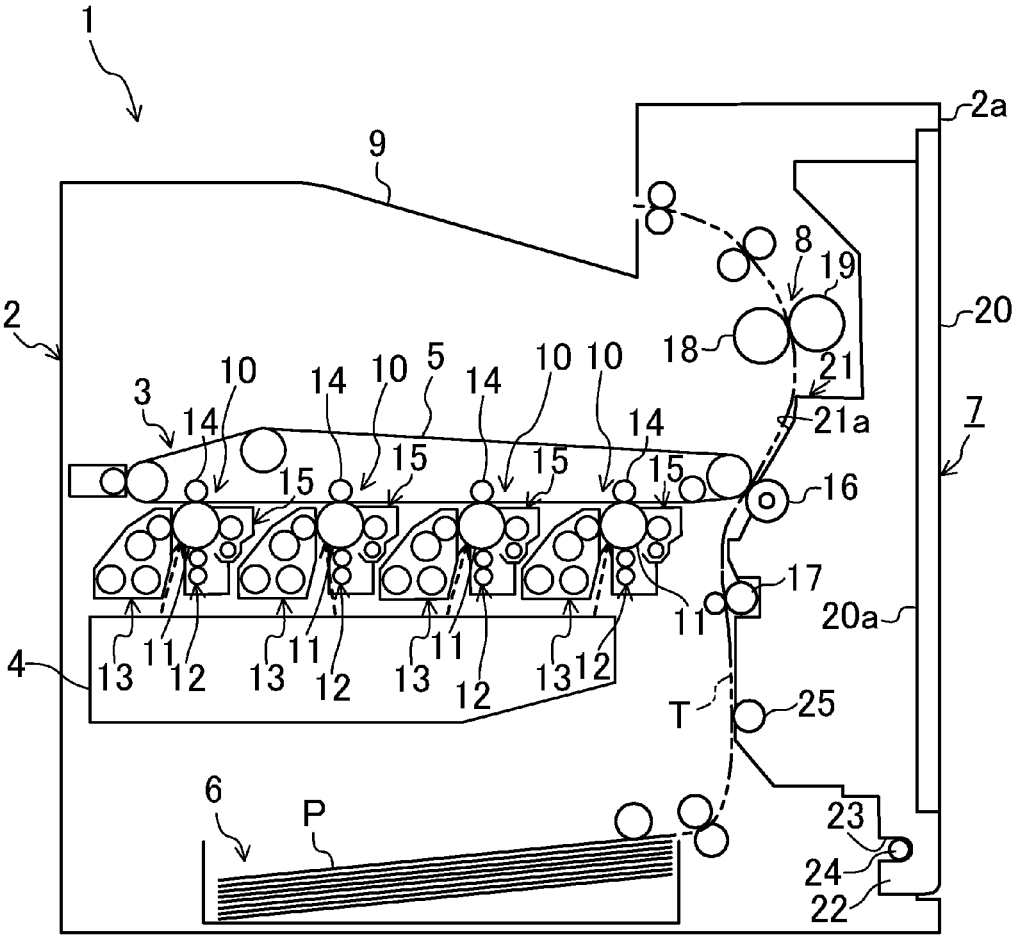
FIG. 1 is a schematic configuration diagram illustrating an image forming apparatus in an embodiment.

FIG. 1 is a schematic configuration diagram illustrating an image forming apparatus 1 in an embodiment. In the following description, it is assumed that a front side and a rear side indicate a front side and a rear side (a front side and a back side in a direction perpendicular to the paper surface of FIG. 1) of the image forming apparatus 1, and a left side and a right side indicate a left side and a right side when the image forming apparatus 1 is viewed from the front side.

The aforementioned image forming apparatus 1 is a tandem type color printer and includes an image forming unit 3 in a box-like housing 2. The image forming unit 3 is an element that transfers an image to a paper P and forms the image on the paper P on the basis of image data transmitted from an external device such as a computer subjected to network connection and the like. Below the image forming unit 3, an exposure device 4 is arranged to irradiate laser light, and above the image forming unit 3, a transfer belt 5 is arranged. Below the exposure device 4, a paper feeding unit 6 is arranged to store the paper P. Above the right side of the transfer belt 5, a fixing unit 8 is arranged to perform a fixing process on the image transferred to and formed on the paper P. At an upper portion of the housing 2, a paper discharge unit 9 is arranged to discharge the paper P subjected to the fixing process in the fixing unit 8. In the image forming apparatus 1, a paper conveyance path T extending toward the paper discharge unit 9 from the paper feeding unit 6 is provided. In image forming apparatus 1, at a right wall portion 2*a* adjacent to the paper conveyance path T, a rectangular opening 7 is formed. The opening 7 is closed by a cover member 20.

The image forming unit 3 includes four image forming units 10 arranged in a row along the transfer belt 5. These image forming units 10 have photosensitive drums 11, respectively. Directly under each photosensitive drum 11, a charging device 12 is arranged, and at the left side of each photosensitive drum 11, a developing device 13 is arranged. Directly above each photosensitive drum 11, a primary transfer roller 14 is arranged, and at the right side of each photosensitive drum 11, a cleaning unit 15 is arranged to clean the peripheral surface of the photosensitive drum 11.

The peripheral surface of each photosensitive drum 11 is constantly electrified by the charging device 12, laser light corresponding to each color based on the image data inputted from the aforementioned computer and the like is irradiated from the exposure device 4 to the electrified peripheral surface of the photosensitive drum 11. As a consequence, an electrostatic latent image is formed on the peripheral surface of each photosensitive drum 11. A developer is supplied to the electrostatic latent images from the developing device 13, so that toner image of yellow, magenta, cyan, or black is formed on the peripheral surface of each photosensitive drum 11. These toner images are respectively superposed on and transferred to the transfer belt 5 by a transfer bias applied to the primary transfer roller 14.

At the right side of the transfer belt 5, a secondary transfer roller 16 is arranged. The secondary transfer roller 16 is arranged in a state of abutting the transfer belt 5. The secondary transfer roller 16 interposes the paper P, which is conveyed along the paper conveyance path T from the paper feeding unit 6, between the secondary transfer roller 16 and the transfer belt 5. A transfer bias is applied to the secondary transfer roller 16, and the toner images on the transfer belt 5 are transferred to the paper P by the applied transfer bias. A reference numeral 17 of FIG. 1 indicates a resist roller that adjusts a timing at which the paper P is supplied to the image forming unit 3, and a reference numeral 25 indicates a guide roller that guides the paper P.

The fixing unit 8 includes a heating roller 18 and a pressing roller 19, and heats while pressing the paper P while interposing the paper P between these heating roller 18 and pressing roller 19. Accordingly, the fixing unit 8 fixes the toner images, which have been transferred to the paper P, to the paper P. The paper P subjected to the fixing process is discharged to the paper discharge unit 9.

The aforementioned cover member 20 is openable and closable, and when a jam has occurred in the paper conveyance path T, the cover member 20 is opened, so that it is possible to easily remove a jammed paper in the paper conveyance path T from the opening 7. The cover member 20 is formed in an approximately rectangular plate shape in correspondence to the shape of the opening 7. At a lower end portion of the cover member 20, a pair of longitudinal wall portions 22 facing each other in the front and rear direction are protruded. At an inner side surface of each longitudinal wall portion 22, an engagement groove 23 engaged with a shaft 24 is formed. The shaft 24 extends along a lower edge portion of the opening 7 and is fixed to the housing 2. That is, the cover member 20 is pivotally supported to the lower edge portion of the opening 7. The cover member 20 rotates around the shaft 24 to open and close the opening 7. FIG. 1 illustrates a closed state in which the cover member 20 closes the opening 7. The opening 7 is opened when the cover member 20 rotates to an outer side (the right side of FIG. 1) of the housing 2 from the closed state by employing the shaft 24 as a fulcrum.

Figure 2:
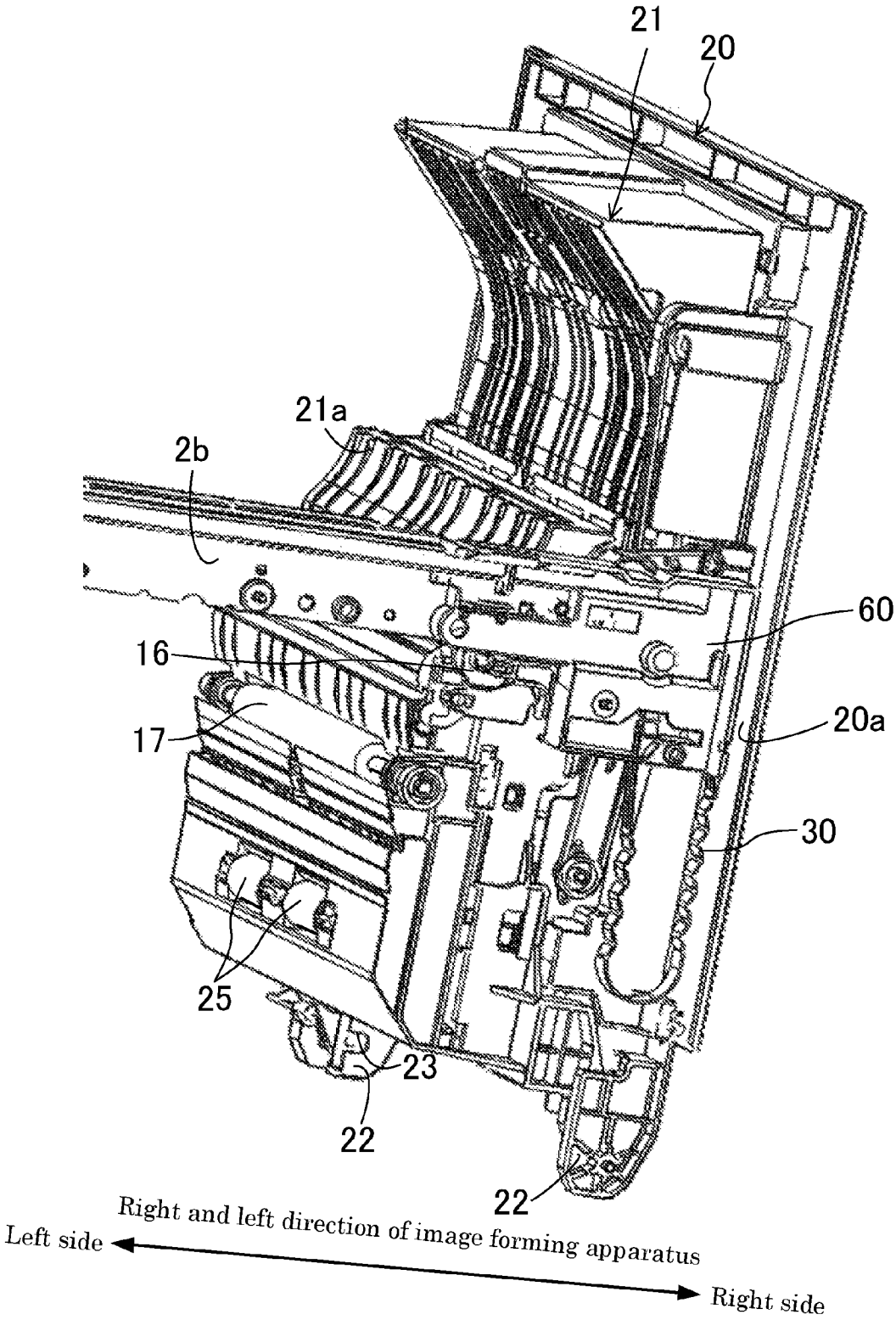
FIG. 2 is a perspective view illustrating a cover member.

As illustrated in FIG. 2, an inner wall surface 20*a* (a surface of an inner side of the image forming apparatus 1) of the cover member 20 is mounted with a guide member 21. The guide member 21 has a paper guide surface 21*a* extending along the paper conveyance path T. The paper guide surface 21*a* is provided with the secondary transfer roller 16, the resist roller 17, and the guide roller 25.

Between the aforementioned cover member 20 and the housing 2, a pair of front and rear support members 30 are provided (FIG. 2 illustrates only the front support member 30). One end portion of each support member 30 is mounted at an inner side surface of the cover member 20 and the other end portion thereof is mounted at a horizontal frame member 2*b* of the housing 2 via a holding member 60. The horizontal frame members 2*b* are respectively arranged at both end portions of the housing 2 in the front and rear direction and horizontally extend in the right and left direction.

Figure 3:
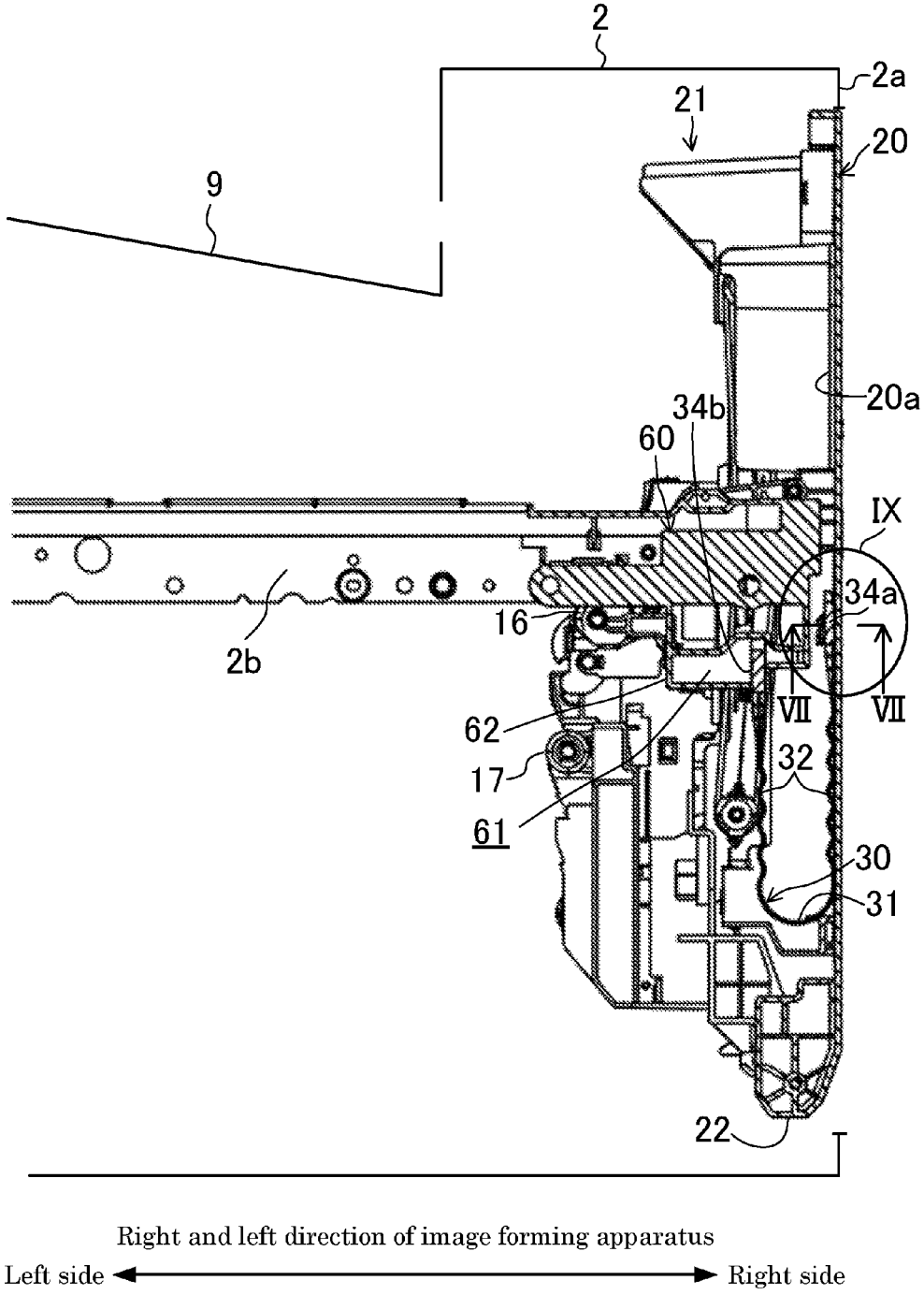
FIG. 3 is a sectional view illustrating a closed state of a cover member.
Figure 4:
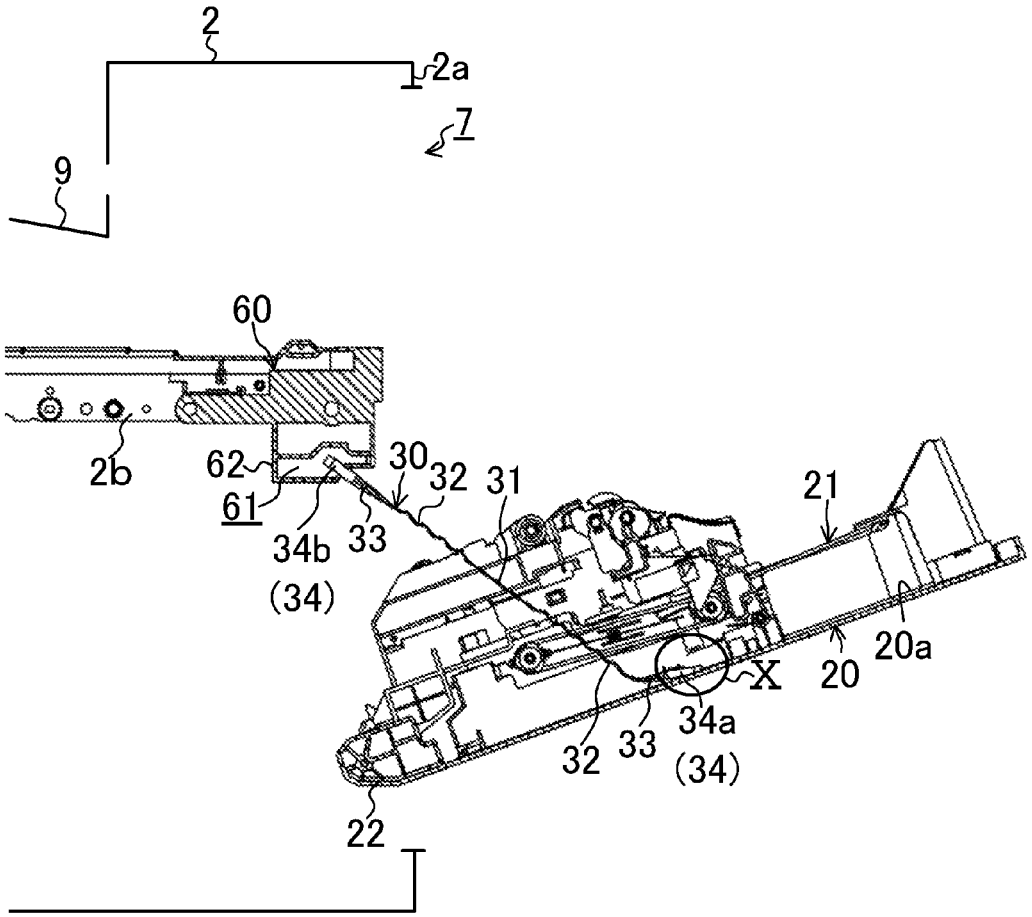
FIG. 4 is a sectional view illustrating an opened state of a cover member.

As illustrated in FIG. 3, when the cover member 20 is in a closed state, the support member 30 is accommodated in the housing 2 in a U-shaped curved state. When the cover member 20 is rotated to an outer side of the housing 2 from the closed state, the support member 30 is modified to a straight line shape from the U shape. Then, when the opening angle of the cover member 20 reaches a maximum opening angle (about 70° in the present embodiment), the support member 30 reaches a stretched state, so that the rotation of the cover member 20 is restricted as illustrated in FIG. 4. Accordingly, the support member 30 restricts the opening angle of the cover member 20 to the maximum opening angle.

Figure 5:
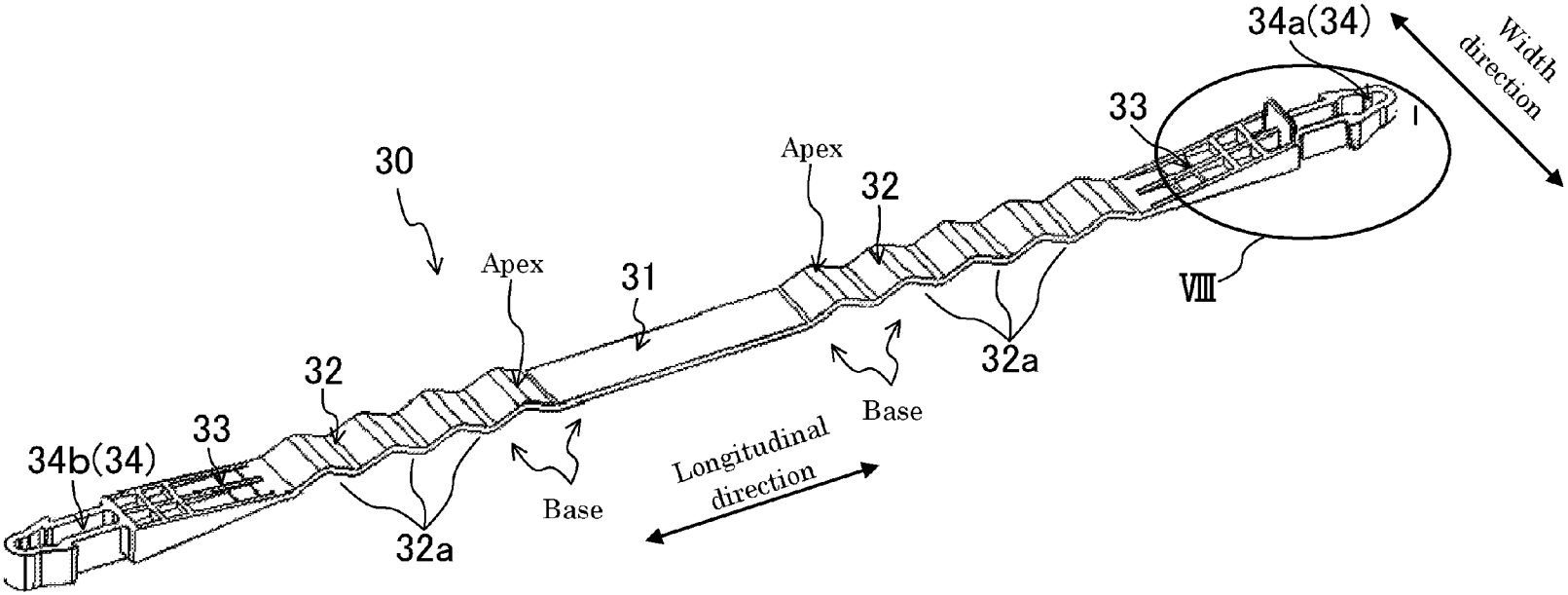
FIG. 5 is an entire perspective view illustrating a state in which a support member has been unfolded in a straight line shape.
Figure 6:
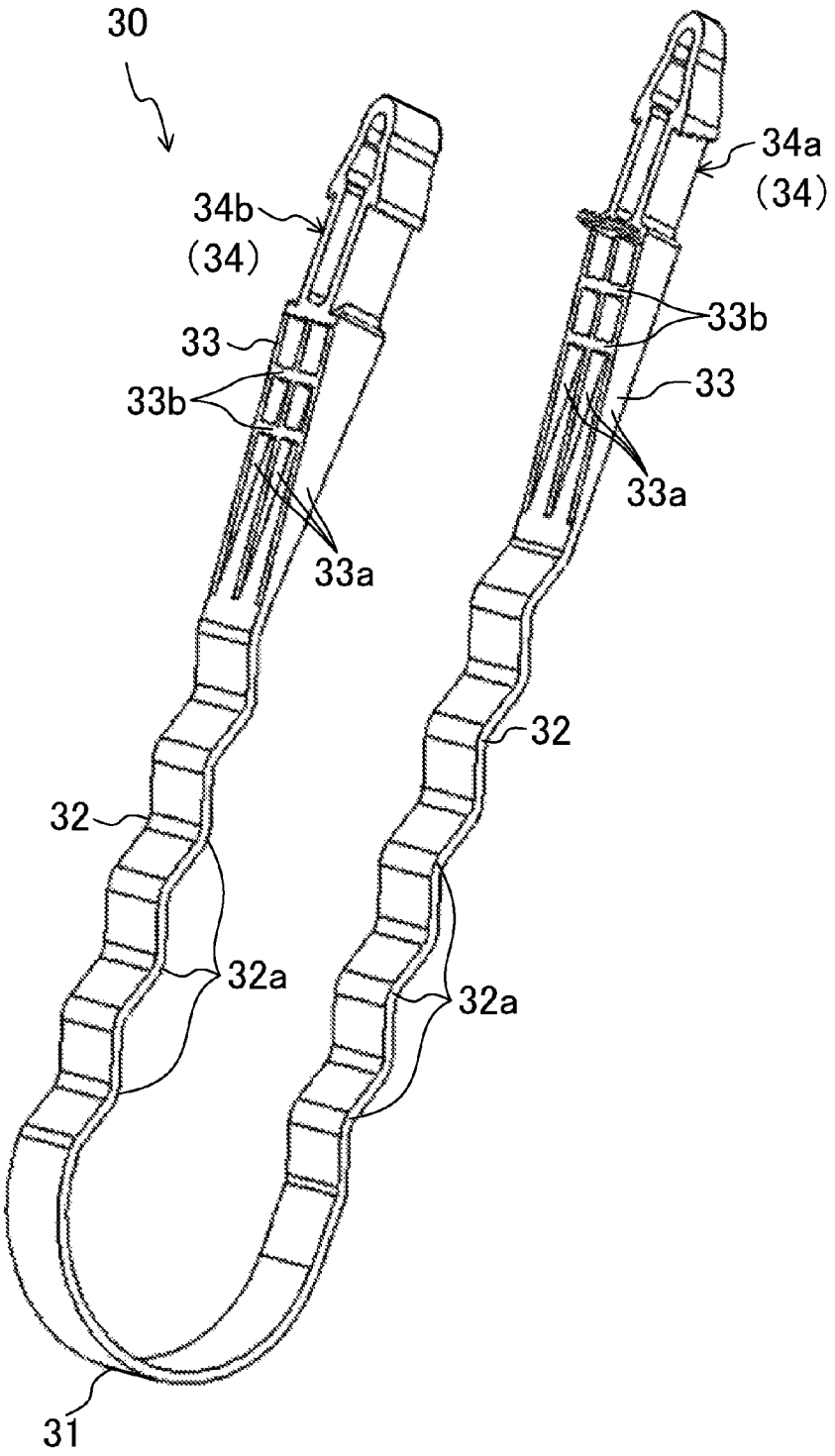
FIG. 6 is an entire perspective view illustrating a state in which a support member has been curved in a U shape.

As illustrated in FIG. 5, the support member 30 includes a flexible member having a long belt shape. As the flexible member, for example, a resin member or a rubber member can be employed. The support member 30 has a flat portion 31, a pair of wavelike portions 32, a pair of tapered portions 33, and a pair of mounting portions 34.

The flat portion 31 is formed at a center part of the support member 30 in a longitudinal direction. The flat portion 31 receives bending stress according to the opening and closing operation of the cover member 20. The flat portion 31 changes from the straight line shape (a flat shape) to the U shape or from the U shape to the straight line shape by the bending stress. The flat portion 31 may be thinly formed as compared with other parts. In this way, at the time of opening and closing of the cover member 20, the flat portion 31 can be easily deformed.

The aforementioned pair of wavelike portions 32 are formed at both sides of the flat portion 31 while interposing the flat portion 31 therebetween. The wavelike portions 32 are respectively connected to both end portions of the flat portion 31 in the longitudinal direction. Each wavelike portion 32 is formed in a wavelike shape when viewed from a width direction perpendicular to the longitudinal direction of the support member 30. Furthermore, each wavelike portion 32 has elasticity in the longitudinal direction of the support member 30. That is, the wavelike portion 32 expands when receives load in a pulling direction and contracts by restoring force when the load is released. Herein, in the case in which a radial direction inside and a radial direction outside of the flat portion 31 when the aforementioned flat portion 31 has been curved in a U shape are respectively employed as a curved inside and a curved outside, each wavelike portion 32 has a plurality of convex portions 32*a* becoming convex at the curved inside thereof. The plurality of convex portions 32*a* are arranged in a row in the longitudinal direction of the support member 30. Each convex portion 32*a* is formed in a mountain shape (an isosceles triangle shape in the present embodiment) when viewed from the width direction of the support member 30. An apex of each convex portion 32*a* is curved in an arc shape when viewed from the width direction of the support member 30. Furthermore, bases of the convex portions 32*a* are connected to each other. Both end portions of the aforementioned flat portion 31 in the longitudinal direction are respectively connected to the bases of the convex portions 32*a* adjacent to (nearest) the flat portion 31 among the plurality of convex portions 32*a* constituting each wave-like portion 32.

The aforementioned pair of tapered portions 33 are respectively connected to the pair of mounting portions 34 formed at both end portions of the support member 30. Each tapered portion 33 is formed such that its thickness is gradually reduced toward the center side from the end side of the support member 30 in the longitudinal direction. The tapered portion 33 has three longitudinal plate portions 33*a* and two transversal rib portions 33*b*. The three longitudinal plate portions 33*a* are upright to the aforementioned curved inside from both ends and the center of the support member 30 in the width direction. Each longitudinal plate portion 33*a* is a right angled triangle-shaped plate portion in which its height is reduced toward the center side from the end side of the support member 30 in the longitudinal direction. The two transversal rib portions 33*b* are arranged spaced apart from each other in the longitudinal direction of the support member 30. Each transversal rib portion 33*b* vertically intersects with the three longitudinal plate portions 33*a* and extends in the width direction of the support member 30.

Figure 7:
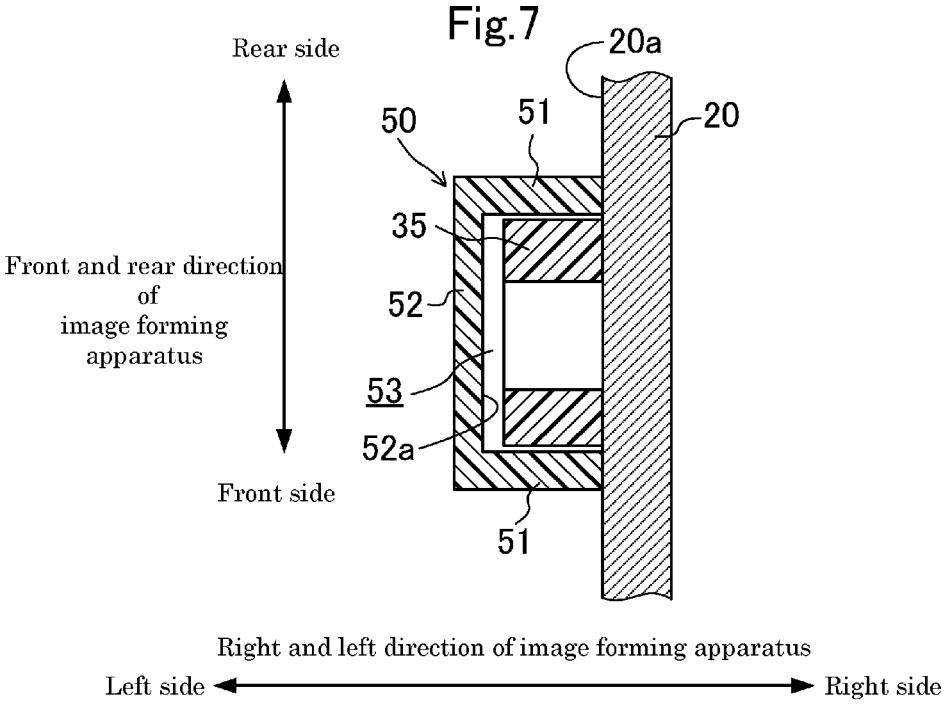
FIG. 7 is a sectional view taken along line VII-VII of FIG. 3.

Between the aforementioned pair of mounting portions 34, one end side mounting portion 34*a* mounted at the cover member 20 is mounted at the cover member 20 by a U-shaped member 50 as illustrated in FIG. 7.

The U-shaped member 50 has a pair of leg parts 51 arranged spaced apart from each other in the front and rear direction, and a connection part 52 that connects the end portions of protruding sides of the pair of leg parts 51 to each other. The pair of leg parts 51 vertically protrude with respect to the inner wall surface 20*a* of the cover member 20 and are fixed to the inner wall surface 20*a*. The connection part 52 is arranged separate from the inner wall surface 20*a* of the cover member 20. Furthermore, a mounting hole 53 is formed by the inner side surface of the cover member 20, the pair of leg parts 51, and the connection part 52.

Figure 8:
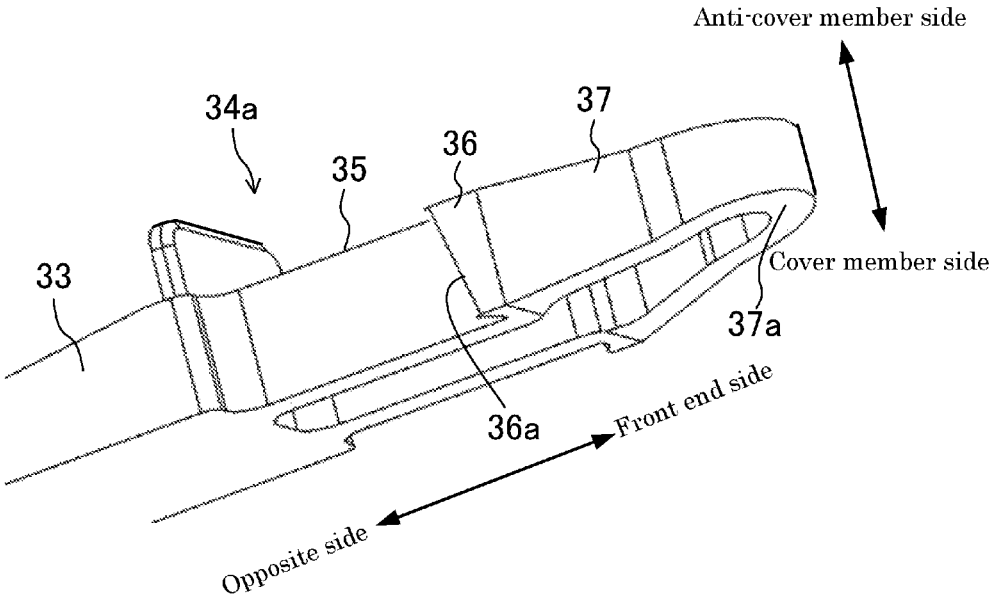
FIG. 8 is an enlarged perspective view of a part VIII of FIG. 5.

As illustrated in FIG. 8, the one end side mounting portion 34*a* of the support member 30 has an insertion portion 35, a locking portion 36, and a support front end portion 37.

In the one end side mounting portion 34*a*, a part, except its outer edge part, is removed when viewed from the thickness direction, so that the one end side mounting portion 34*a* is formed in a frame shape. The insertion portion 35 is inserted into the aforementioned mounting hole 53 (see FIG. 7) formed by the cover member 20 and the U-shaped member 50. The locking portion 36 protrudes to both sides of the insertion portion 35 in the width direction from the front end portion of the insertion portion 35. The locking portion 36 is hooked with the pair of leg parts 51 of the U-shaped member 50, thereby preventing the aforementioned insertion portion 35 from coming off from the mounting hole 53. The support front end portion 37 is connected to an opposite side to that of the insertion portion 35 side in the locking portion 36. The support front end portion 37 is formed in a triangular frame shape in which its width is narrowed toward the front end side when viewed from the thickness direction. As described above, the width of the support front end portion 37 is formed to be narrowed toward the front end side, the one end side mounting portion 34*a* can be easily put into the mounting hole 53. At a surface (a surface facing the inner wall surface 20*a* of the cover member 20) of the cover member side of the support front end portion 37, an inclination surface portion 37*a* is formed over the entire surface. The inclination surface portion 37*a* is inclined to an anti-cover member side (a side opposite to the cover member) as it goes toward the front end side (see FIG. 9).

Figure 9:
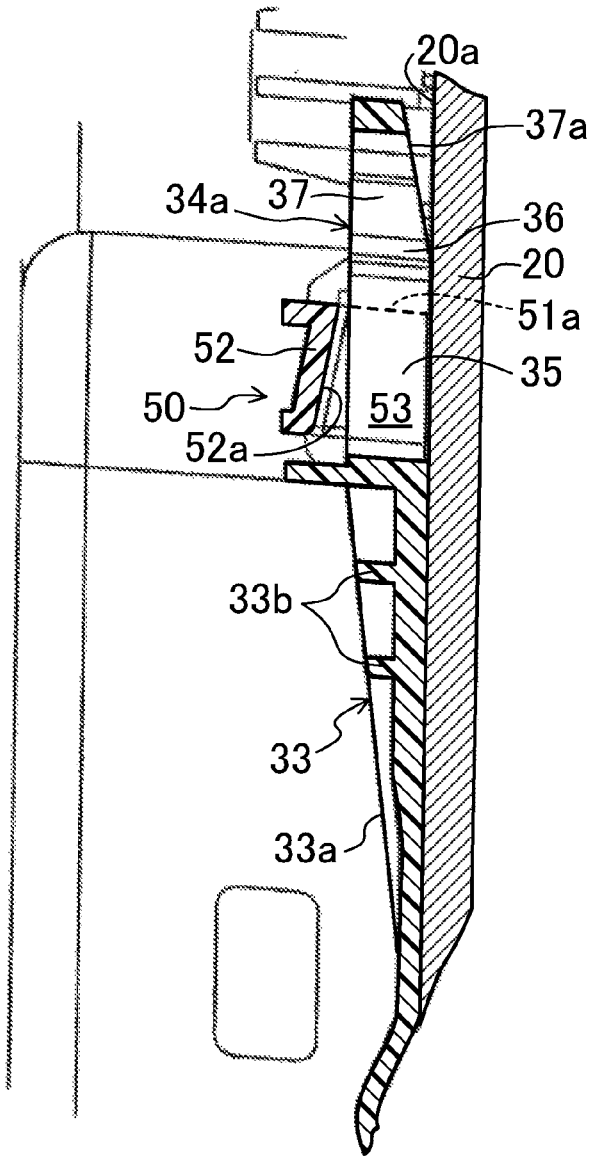
FIG. 9 is an enlarged view of a part IX of FIG. 3.

An inner side surface (a surface facing the insertion portion 35) 52*a* of the connection part 52 of the U-shaped member 50 is inclined at an angle equal to that of the inclination surface portion 37*a* in an opposite direction to that of the aforementioned inclination surface portion 37*a* as illustrated in FIG. 9. Here, FIG. 9 illustrates the case in which the cover member 20 is in in the closed state. In this state, the entire surface of the cover member side of the insertion portion 35 abuts the inner wall surface 20*a* of the cover member 20. A gap exists between the surface of the anti-cover member side of the insertion portion 35 and the connection part 52 of the U-shaped member 50.

Figure 10:
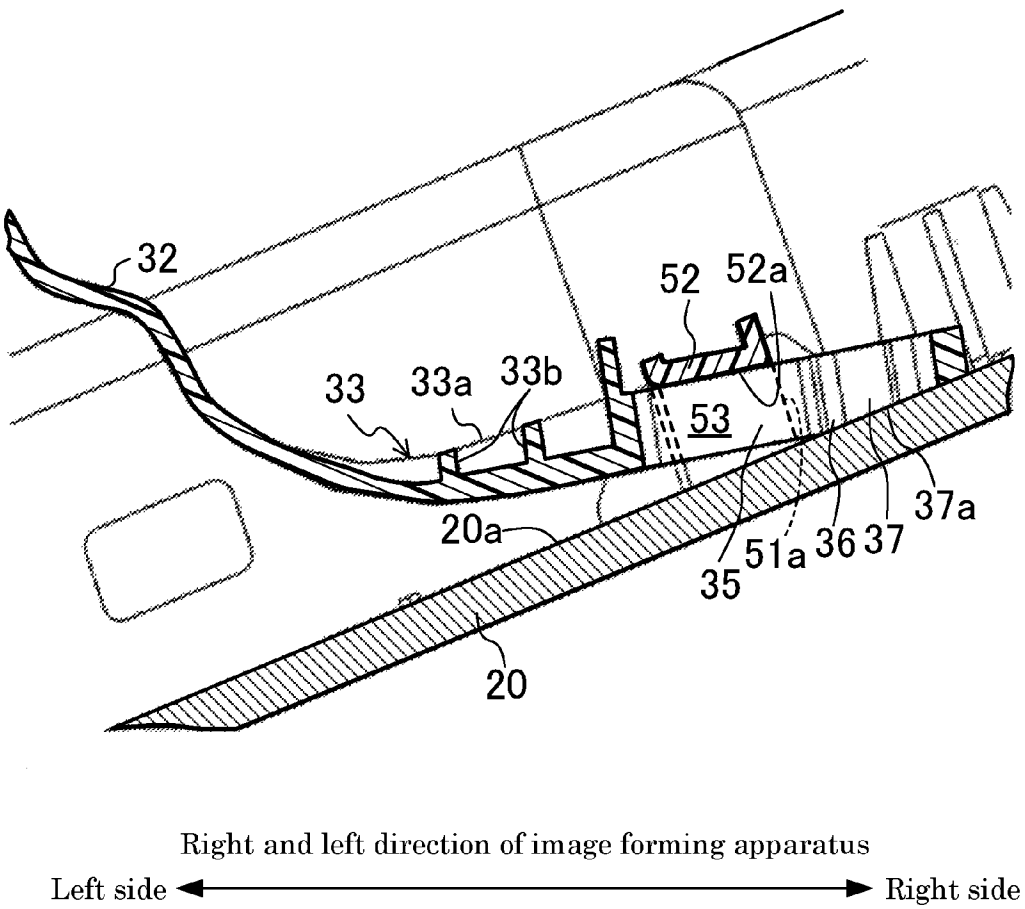
FIG. 10 is an enlarged view of a part X of FIG. 4.

When the cover member 20 is opened to the maximum opening angle from the closed state, the one end side mounting portion 34*a* is slightly inclined in the mounting hole 53 by tension acting on the support member 30 (see FIG. 10). As a consequence, the inclination surface portion 37*a* of the one end side mounting portion 34*a* abuts the inner wall surface 20*a* of the cover member 20, and the surface of the anti-cover member side of the insertion portion 35 abuts the inner side surface 52*a* of the connection part 52 of the U-shaped member 50. As described above, the one end side mounting portion 34*a* is fixed so as to be slightly tiltable without being completely fixed to the cover member 20, so that excessive bending load is prevented from applying to the vicinity of the root of the one end side mounting portion 34*a*.

A hooking surface 36*a* (see FIG. 8) with the aforementioned pair of leg parts 51 in the locking portion 36 of the one end side mounting portion 34*a* is inclined at an opposite side to the front end side of the support member 30 toward the anti-cover member side from the cover member side. Furthermore, in the state in which the cover member 20 has been opened to the maximum opening angle (the state of FIG. 10), the hooking surface 36*a* is formed to make surface contact with hooked surfaces 51*a* of the pair of leg parts 51.

Figure 11:
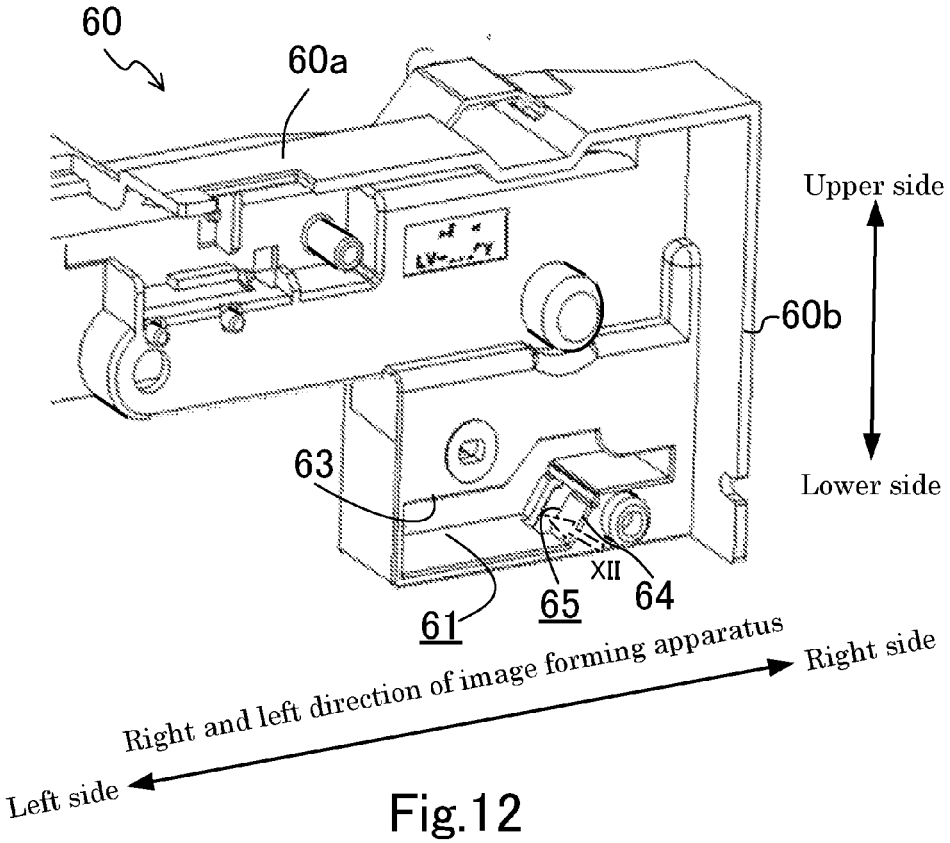
FIG. 11 is a perspective view illustrating a holding member that holds the other end portion of a support member when viewed from the front side and the left side of an image forming apparatus.
Figure 12:
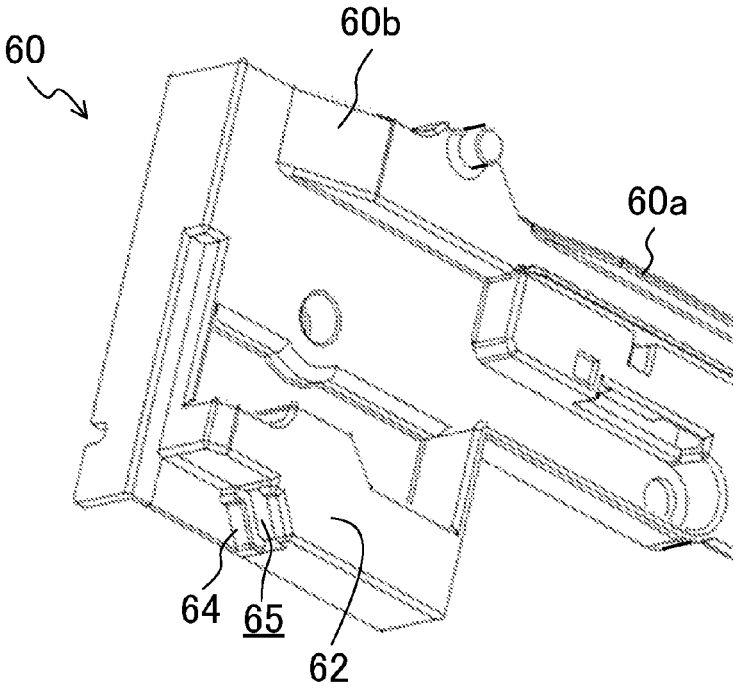
FIG. 12 is a view viewed in the arrow direction of XII of FIG. 11.

The aforementioned one end side mounting portion 34*a* and the other end side mounting portion 34*b* of an opposite side are mounted at the aforementioned holding member 60 in a half-fixed state. The holding member 60 is made of a resin member having an approximately L shape in a whole view as illustrated in FIG. 11 and FIG. 12. That is, the holding member 60 has a horizontal part 60*a* horizontally fixed to a front end portion of the horizontal frame member 2*b* and a vertical part 60*b* extending downward from a front end portion of the horizontal part 60*a*. At a lower end portion of the vertical part 60*b*, a hollow case part 62 is formed. At a lower end portion of the case part 62, an inclined wall 64 inclined upward from the left to the right is formed. In the present embodiment, an inclination angle of the inclined wall 64 is 45°. The inclined wall 64 is formed with a through hole 65 which vertically passes through the inclined wall 64. The through hole 65 is a long hole having a rectangular shape which is long in an inclination direction of the inclined wall 64. In the present embodiment, the through hole 65 is formed over the entire range from a lower end to an upper end of the inclined wall 64. A hollow portion 61 of the case part 62 communicates with an exterior of the case part 62 via the through hole 65. The case part 62 is formed at a side wall portion thereof with an opening hole 63. When the other end side mounting portion 34*b* (having a shape similar to that of the one end side mounting portion 34*a* illustrated in FIG. 8)

is inserted into the through hole 65, the locking portion 36 passes through the through hole 65. Furthermore, the insertion portion 35 of the other end side mounting portion 34*b* passes through the through hole 65, so that the locking portion 36 is hooked with a peripheral edge portion of the through hole 65 from the inner side of the case. In this way, the other end side mounting portion 34*b* is held to the case part 62. Herein, when the cover member 20 is in the closed state, the other end side mounting portion 34*b* is vertically arranged when viewed from the front side of the image forming apparatus 1 as illustrated in FIG. 3. When the cover member 20 is opened to the maximum opening angle, the other end side mounting portion 34*b* is inclined leftward and toward a vertical upper side when viewed from the front side of the image forming apparatus 1 as illustrated in FIG. 4. Since the through hole 65 is formed in a long hole shape as described above, even when the other end side mounting portion 34*b* has been inclined leftward and toward the vertical upper side from the vertical state, the peripheral edge portion of the through hole 65 and the other end side mounting portion 34*b* do not interfere with each other. That is, the through hole 65 is formed so as to permit a change in the inclination angle of the other end side mounting portion 34*b* with respect to a vertical direction, which occurs while the cover member 20 is changing to a curved state and a stretched state linking with its own opening and closing.

As described above, in the aforementioned image forming apparatus 1, if the cover member 20 is rotated to an outer side of the housing 2, the support member 30 reaches a stretched state when the opening angle of the cover member 20 has reached the maximum opening angle. When the support member 30 reaches the stretched state, large impact force acts on the support member 30 by the cover member 20. Particularly, similarly to the aforementioned embodiment, in the image forming apparatus 1, the guide member 21, the secondary transfer roller 16, the resist roller 17, the guide roller 25 and the like are integrally mounted at the cover member 20, resulting in a significant increase in the impact force acting on the support member 30 by the cover member 20 when the support member 30 has been stretched. Therefore, in a conventional image forming apparatus 1, the support member 30 may be broken by the impact force from the cover member 20.

However, in the aforementioned embodiment, the wavelike portions 32 are formed at an intermediate part of the support member 30 in the longitudinal direction. In this way, when the cover member 20 has been opened to the maximum opening angle, the wavelike portions 32 expand from the contracted state (the state of FIG. 5), so that the impact force acting on the support member 30 by the cover member 20 is attenuated. Thus, it is possible to prevent the support member 30 from being broken by the impact force from the cover member 20 at the time of opening.

Furthermore, in the aforementioned embodiment, the flat portion 31 is formed at a part of the support member 30, to which bending stress is applied at the time of opening and closing of the cover member 20, and the aforementioned wavelike portions 32 are formed at both sides of the flat portion 31 while interposing the flat portion 31 therebetween.

According to this, when the cover member 20 enters the closed state and the support member 30 is accommodated in the cover member 20, the wavelike portions 32 are not bent and only the flat portion 31 is bent in a U shape. Consequently, it is possible to prevent the wavelike portions 32 from being broken or being plastically deformed due to unreasonable bending stress acting on the wavelike portions 32. Thus, it is possible to maintain an impact absorption function by the wavelike portions 32 for a long time.

Figure 13:
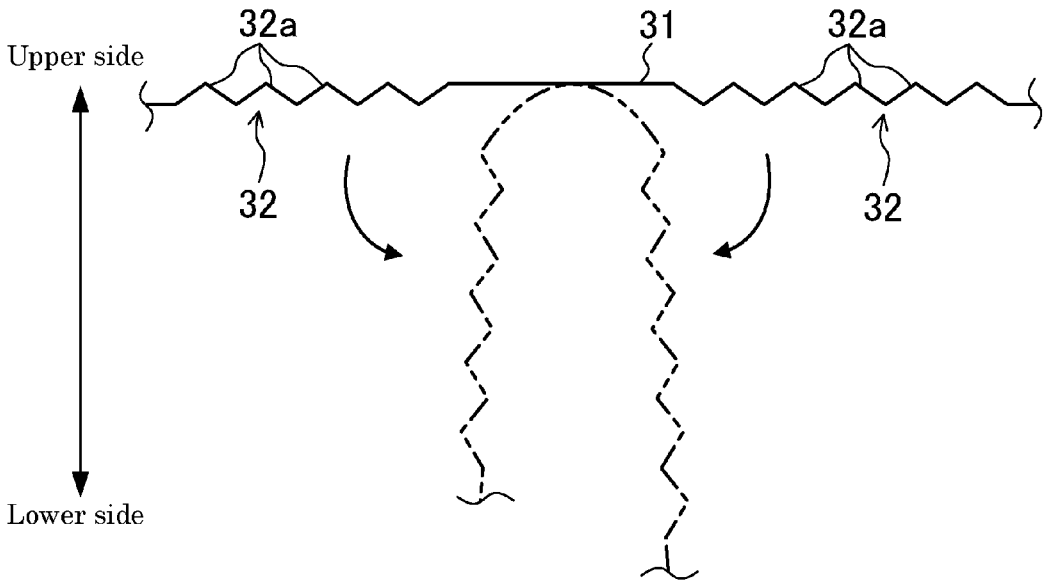
FIG. 13 is a schematic view illustrating a support member in a comparison example.

Furthermore, in the aforementioned embodiment, both end portions of the flat portion 31 in the longitudinal direction are respectively connected to the bases (not apexes) of the convex portions 32*a* adjacent to the flat portion 31 among the plurality of convex portions 32*a* constituting each wavelike portion 32. Consequently, when the cover member 20 has entered the closed state, the support member 30 can be bent in a U shape becoming convex downward and can be accommodated in the housing 2 as illustrated in FIG. 3. Herein, both end portions of the flat portion 31 are also be considered to be connected to the apexes of the convex portions 32*a* as illustrated in FIG. 13. However, in this case, when the cover member 20 has entered the closed state, since the upper side of the support member 30 becomes convex as indicated by a two dot chain line of FIG. 13, there is a case in which the support member 30 is not successfully accommodated in the housing 2. However, in the aforementioned configuration, when the cover member 20 has entered the closed state, the upper side of the support member 30 is prevented from being convex, so that the support member 30 can be reliably accommodated in the housing 2.

Herein, in the aforementioned image forming apparatus 1, if the cover member 20 is rotated to the outer side of the housing 2, the support member 30 enters a stretched state when the opening angle of the cover member 20 has reached the maximum opening angle. Herein, in the case in which the one end side mounting portion 34*a* of the support member 30 has been completely fixed to the inner wall surface of the cover member 20 by a screw and the like, when the support member 30 enters the stretched state, since large bending load applies to the vicinity of the root of the insertion portion 35 of the one end side mounting portion 34*a*, the support member 30 may be broken.

However, in the aforementioned embodiment, as illustrated in FIG. 9 and FIG. 10, while the cover member 20 is being opened to the maximum opening angle from the close state, the insertion portion 35 of the one end side mounting portion 34*a* of the support member 30 is slightly inclined in a surface, which is vertical to the shaft 24 serving as a rotation fulcrum of the aforementioned cover member 20, in the mounting hole 53. Consequently, as compared with the case in which the insertion portion 35 is fixed in the mounting hole 53, it is possible to reduce bending load applying to the vicinity of the root of the insertion portion 35 at the time of maximum opening of the cover member 20.

Furthermore, since the inclination surface portion 37*a* inclined to the anti-cover member side from the cover member side toward the front end side is formed at the surface of the cover member side of the support front end portion 37, it is possible to secure a sufficiently large tiltable range of the insertion portion 35 in the mounting hole 53, as compared with the case in which the inclination surface portion 37*a* is not formed. Consequently, it is possible to further reduce the bending load applying to the vicinity of the root of the insertion portion 35.

Furthermore, in the aforementioned embodiment, the inner side surface 52*a* of the connection part 52 of the U-shaped member 50 is inclined at the same inclination angle as that of the inclination surface portion 37*a* in an opposite direction to that of the inclination surface portion 37*a*.

Consequently, while the cover member 20 is being opened, the tilting operation of the insertion portion 35 in the aforementioned the mounting hole 53 can be prevented from being blocked by the inner side surface 52*a* of the connection part 52 of the U-shaped member 50.

Furthermore, in the aforementioned embodiment, the hooking surface 36*a* of the locking portion 36 of the one end side mounting portion 34*a* is formed to make surface contact with the hooked surfaces 51*a* of the pair of leg parts 51 of the U-shaped member 50 in the state of abutting the inner wall surface 20*a* of the cover member 20 (in the maximally opened state of the cover member 20).

According to this, when the cover member 20 has been opened to the maximum opening angle, since the hooking surface 36*a* of the locking portion 36 makes surface contact with the hooked surfaces 51*a* of the pair of leg parts 51, it is possible to prevent large pressing load from locally acting on the locking portion 36. Accordingly, it is possible to prevent the one end side mounting portion 34*a* of the support member 30 from coming off from the cover member 20 due to the breakage of the locking portion 36.

Moreover, in the aforementioned embodiment, the horizontal frame member 2*b* constituting a part of the housing 2 is provided with the holding member 60 that holds the other end side mounting portion 34*b* of the support member 30. The holding member 60 has the hollow case part 62 and the through hole 65 formed at the inclined wall 64 of the case part 62, and the other end side mounting portion 34*b* of the support member 30 has the insertion portion 35 inserted into the aforementioned through hole 65 and the locking portion 36 which is connected to the front end portion of the insertion portion 35 and is hooked with the peripheral edge portion of the through hole 65, thereby preventing the insertion portion 35 from coming off from the through hole 65. Furthermore, the through hole 65 is formed in a long hole shape so as to permit a change in the inclination angle of the other end side mounting portion 34*b* of the support member 30 with respect to a vertical direction, which occurs linking with the opening and closing of the cover member 20.

Consequently, as compared with the case in which the other end side mounting portion 34*b* of the support member 30 is completely fixed to the housing by a screw and the like, it is possible to reduce bending load acting on the other end side mounting portion 34*b* at the time of the opening and closing of the cover member 20.

Furthermore, in the aforementioned image forming apparatus 1, the tapered portions 33 are formed at the respective roots of the one end side mounting portion 34*a* and the other end side mounting portion 34*b* of the support member 30. The tapered portion 33 is formed such that its thickness is gradually reduced toward the center side of the support member 30 in the longitudinal direction.

According to this, it is possible to avoid stress concentration due to a discontinuous change in the thickness of the support member 30 at one end portion and the other end portion thereof. Thus, it is possible to prevent the one end portion and the other end portion of the support member 30 from being broken by the aforementioned impact force when the cover member 20 has been opened to the maximum opening angle.

Other Embodiments

In the aforementioned embodiment, the example in which the image forming apparatus 1 is a printer has been described. However, the technology of the present disclosure is not limited thereto, and the image forming apparatus 1, for example, may be a copy machine, a multifunctional peripheral (MFP) and the like.

In the aforementioned embodiment, the convex portion 32*a* constituting the wavelike portion 32 is formed in approximately isosceles triangle shape when viewed from the width direction of the support member 30. However, the technology of the present disclosure is not limited thereto, and the convex portion 32*a*, for example, may be formed in a semicircular shape. Furthermore, in the aforementioned embodiment, the apex of each convex portion 32*a* is formed in an arc shape when viewed from the width direction of the support member 30. However, the technology of the present disclosure is not limited thereto, and the apex of each convex portion 32*a* may have an acute angle shape or may be sharpened at an obtuse angle.

Furthermore, in the aforementioned embodiment, the inclination surface portion 37*a* is formed on the entire surface of the cover member side of the support front end portion 37. However, the technology of the present disclosure is not limited thereto, and for example, the inclination surface portion 37*a* may also be formed only at a part of the front side of the surface of the cover member side.

What is claimed is:

1. An image forming apparatus comprising:

a housing accommodating an image forming unit therein and having an opening at one side surface thereof;

a cover member pivotally supported to a lower edge portion of the opening and rotated to an outer side of the housing from a closed state, in which the opening is closed, by employing a shaft as a fulcrum, thereby opening the opening; and a long belt-shaped support member having one end portion mounted at the housing and the other end portion mounted at the cover member, and restricting an opening angle of the cover member to a predetermined maximum opening angle, wherein the one end portion and the other end portion of the support member have tapered portions, respectively, and a thickness of each tapered portion is gradually reduced toward a center side from an end side of the support member in a longitudinal direction, a wavelike portion is connected to an end portion of the center side of the support member in the longitudinal direction with respect to the tapered portion of the support member, and the wavelike portion has a plurality of convex portions arranged in a row in the longitudinal direction, each convex portion being formed in a mountain shape when viewed from a width direction perpendicular to the longitudinal direction of the support member, and the wavelike portion is configured to expand when a load is received in a pulling direction and contract by a restoring force when the load is released.

2. The image forming apparatus of claim 1, wherein the width direction of the support member of the long belt-shaped support member coincides with an axial direction of a rotation shaft of the cover member, the image forming apparatus further comprises:

a U-shaped member having a pair of leg parts fixed to an inner wall surface of the cover member; and a connection part arranged separate from the inner wall surface and connecting the pair of leg parts to each other, and one end portion of the support member has an insertion portion inserted into a mounting hole formed by the inner wall surface of the cover member and the U-shaped member, and a locking portion which is connected to a front end portion of the insertion portion and is hooked with the pair of leg parts of the U-shaped member, thereby preventing the insertion portion from coming off from the mounting hole.

* * * * *